United States Patent [19]

Lackore et al.

[11] 4,141,060

[45] Feb. 20, 1979

[54] ULTRAVIOLET LIGHT PROCESSOR HAVING MOVABLE REFLECTORS

[75] Inventors: James K. Lackore, Joliet; Warren J. Ramler, Aurora, both of Ill.

[73] Assignee: PPG Industries, Inc., Pittsburgh, Pa.

[21] Appl. No.: 766,645

[22] Filed: Feb. 8, 1977

Related U.S. Application Data

[63] Continuation of Ser. No. 587,942, Jun. 18, 1975, abandoned.

[51] Int. Cl.[2] ..... F21V 7/04

[52] U.S. Cl. ..... 362/33; 362/97; 362/213; 362/232; 34/4

[58] Field of Search ..... 240/44.1, 51.11, 47, 240/11.4, 1.3; 355/85; 34/4, 41; 362/33, 97, 213, 232

[56] References Cited

U.S. PATENT DOCUMENTS

| | | | |
|---|---|---|---|
| 2,565,570 | 8/1951 | Messinger | 219/19 |
| 3,099,403 | 7/1963 | Strawick | 240/44.1 X |
| 3,375,752 | 4/1968 | Fairbanks et al. | 240/44.1 X |
| 3,379,112 | 4/1968 | Cranskens | 355/71 X |
| 3,538,324 | 11/1970 | Hankins | 240/44.1 X |
| 3,745,307 | 7/1973 | Peek, Jr. et al. | 34/4 X |
| 3,819,929 | 6/1974 | Newman | 240/44.1 X |
| 3,826,014 | 7/1974 | Helding | 240/47 X |
| 3,831,289 | 8/1974 | Knight | 34/4 X |
| 3,848,998 | 11/1974 | Yonekura et al. | 355/100 |
| 3,862,397 | 1/1975 | Anderson et al. | 240/47 X |
| 3,869,605 | 3/1975 | Davis | 240/47 |
| 3,949,215 | 4/1976 | Whitney | 240/44.1 |
| 4,000,407 | 12/1976 | Keller et al. | 240/47 |
| 4,005,135 | 1/1977 | Helding | 34/4 X |

FOREIGN PATENT DOCUMENTS

| | | |
|---|---|---|
| 163605 | 10/1905 | Fed. Rep. of Germany. |
| 608864 | 9/1948 | United Kingdom. |

*Primary Examiner*—Peter A. Nelson

*Attorney, Agent, or Firm*—George D. Morris; J. Timothy Keane

[57] ABSTRACT

Ultraviolet light processors are provided with means for moving concave cylindrical reflectors toward and away from generally linear sources of ultraviolet light associated with the reflectors to change the distribution of intensity of ultraviolet light impinging upon a workpiece.

5 Claims, 4 Drawing Figures

ULTRAVIOLET LIGHT PROCESSOR HAVING MOVABLE REFLECTORS

This is a continuation of application Ser. No. 587,942, filed June 18, 1975, now abandoned.

Processes in which products are treated with ultraviolet light, such as to effect polymerization, sterilization, etc., are becoming of increasing interest. The use of ultraviolet light coating processors to cure ultraviolet light sensitive coatings is especially becoming more widespread. Advantages of ultraviolet light curing include the ability to use resin systems which have little or no volatile solvents, the speed with which cure may be accomplished and simplicity of operation.

The curing of many ultraviolet light curable coating compositions is dose rate dependent. Some compositions require an ultraviolet light intensity below a maximum permissible intensity. Many compositions require an ultraviolet light intensity above a threshold value for there to be any meaningful rate of crosslinking. Although it is not desired to be bound by any theory, it is believed that the ultraviolet light intensity at any distance below the surface of a film of ultraviolet light curable coating composition is at least approximately given by the formula:

$$I = I_o e^{-\alpha x}$$

where I is the ultraviolet light intensity at a depth x below the surface of the film, $I_o$ is the intensity of ultraviolet light just entering the surface of the film and $\alpha$ is an extinction coefficient, the value of which is a characteristic of the particular coating composition being exposed to ultraviolet light. It is possible for the extinction coefficient to vary as crosslinking progresses because the composition of the film is changing. Usually the change is small and it is therefore often ignored. If the intensity at the surface, $I_o$, it can happen that the intensity I at some depth x is at the threshold value of the coating composition. When this occurs, the coating is crosslinked from the surface to the depth x whereas little crosslinking occurs at greater depths. By increasing the intensity $I_o$, the depth at which the intensity I is above the threshold value is increased. In most cases, it is desired that the intensity $I_o$ be great enough so that the intensity I is above the threshold value throughout the total thickness of the film. Unfortunately, many sources of ultraviolet light also emit large quantities of heat, the intensity of which in the coating also tends to follow the above equation. It is therefore desirable to adjust the system so that the coating receives ultraviolet light above the threshold intensity for a time sufficient to achieve the desired degree of crosslinking, yet without subjecting the coating composition or the substrate to heat of such intensity as would cause thermal damage.

The present invention serves to permit changing the distribution of intensity of ultraviolet light impinging upon a workpiece to accommodate different coating compositions on the same ultraviolet light processor. This is accomplished by providing an ultraviolet light processor having at least one generally linear source of ultraviolet and a concave cylindrical reflector for reflecting ultraviolet light from the source to a workpiece, with means for moving the concave cylindrical reflector toward and away from the generally linear source and the workpiece. Usually the generally linear source is mounted in fixed position on the framework of the processor.

Although the ultraviolet light processor may have only one source of ultraviolet light and one reflector, it is more common for there to be a plurality of generally linear sources of ultraviolet light, each of such sources having in association therewith a concave cylindrical reflector for reflecting ultraviolet light from its associated source to the workpiece. One embodiment of the present invention is means for moving the concave cylindrical reflectors toward and away from their associated sources and the workpiece to thereby change the distribution of intensity of ultraviolet light impinging upon the workpiece. Usually, the generally linear sources of ultraviolet light are mounted in fixed positions on the framework of the processor.

For a better understanding of the invention, reference may be made to the drawings wherein like reference numerals refer to like parts in which.

Figure 1:
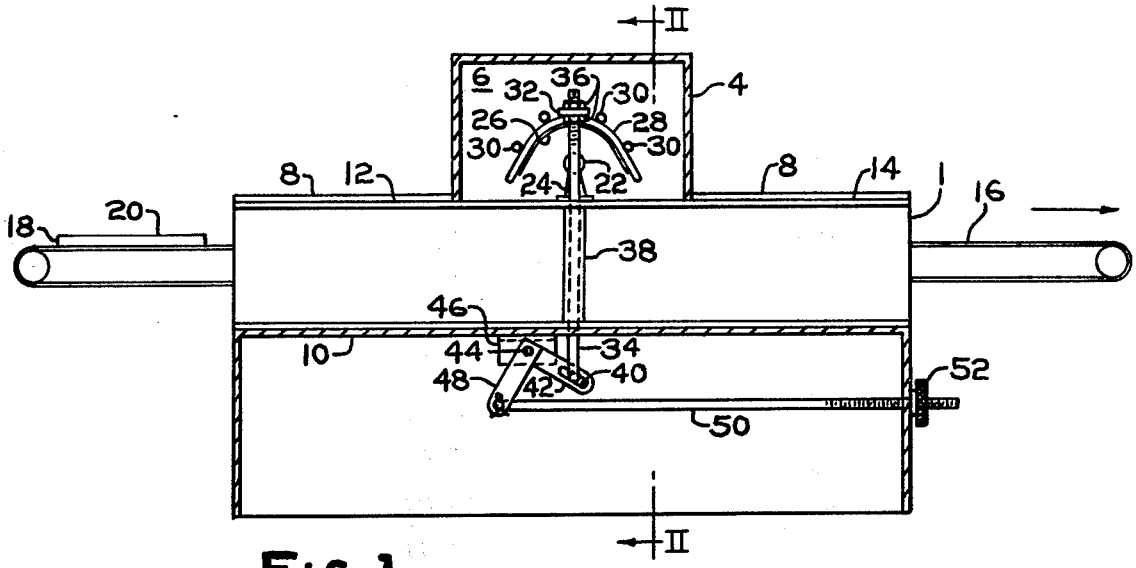
FIG. 1 illustrates an ultraviolet light processor of the present invention and is a sectional view taken along the line I—I of FIG. 2.
Figure 2:
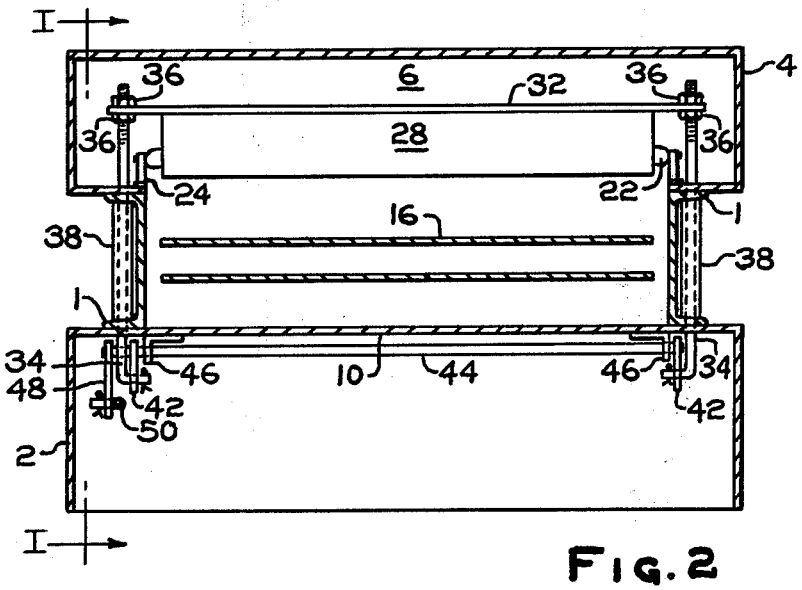
FIG. 2 is a sectional view taken aong the line II—II of FIG. 1.

Referring now in more detail to the FIGURES where the invention will be described with respect to illustrative embodiments thereof, FIGS. 1 and 2 show channels 1 supporting skirt 2 and housing 4 of chamber 6. The weight of the apparatus is borne by legs, not shown, positioned under channels 1. Plates 8 cooperate with channels 1 and the horizontal portion 10 of skirt 2 to form entrance tunnel 12 and exit tunnel 14 separated by the chamber 6. Access doors and panels, not shown, may be placed in convenient locations in housing 4, skirt 2 and, if necessary, in the tunnels 12 and 14. Conveyor 16 carries a workpiece 18 having a coating 20 of ultraviolet light curable coating composition on the upper surface thereof. Within chamber 6 is located mercury vapor lamp 22 held by lamp mounting brackets 24 and connected to a source of electrical energy, not shown. The lamp mounting brackets may advantageously, although not necessarily, be of the type described in U.S. Pat. No. 3,906,217. The reflectors may be bright aluminum sheet (e.g. "Alzak," Aluminum Company of America; "Lurium," of European origin) or other ultraviolet light reflective material and may be held in place by screws, not shown. Advantageously, base member 28 may have affixed thereto conduit 30 (not shown in FIG. 2) for circulating coolant therethrough. The ends of the conduit may be attached to a source and sink, respectively, of coolant by means of flexible tubing. Base member 28 is suspended by beam 32. The threaded ends of rods 34 pass through holes in the ends of beam 32. Nuts 36 establish the position of beam 32 on rods 34. Rods 34 pass through holes in the flanges of channels 1. Advantageously, rods 34 also pass through tubes 38 located between the flanges and affixed thereto. The close tolerance between the tubes and the rods makes a tortuous path which reduces contamination of the atmosphere within chamber 6 by the air surrounding the apparatus. This is particularly beneficial when an atmosphere having a composition different from that of air is maintained within chamber 6. Some curing processes, for example, require the use of atmospheres containing only very small amounts of oxygen. Grease may be placed in the annulus between the rods and the tubes to further reduce atmospheric contamination. The lower ends of rods 34 are bent about ninety degrees and pass through elongated holes 40 in arms 42 which are welded or otherwise affixed to axle 44. Cotter pins retain rods 34 in elongated holes 40. Axle 44 passes through bearings 46 attached to the framework of the processor. Also affixed to axle 44 is arm 48. The end of rod 50, which has been bent about ninety degrees, is passed through a hole in arm 48 and secured in place with a cotter pin. The other end of rod 50, which is threaded, passes through a hole in skirt 2. Handwheel 52 engages the threaded portion of rod 50. The position of handwheel 52 on rod 50 determines the distance reflector 26 is positioned from mercury vapor lamp 22 and a workpiece passing under the lamp. Turning handwheel 52 to pull the end of arm 48 closer to the handwheel elevates reflector 26. Conversely, turning handwheel 52 to permit the end of arm 48 to recede from the handwheel lowers reflector 26.

Generally, the concave reflectors are substantially elliptical cylindrical reflectors. Each such reflector has a first focus and a second focus more remotely located from the reflectors than the first focus. The eccentricity of the substantially elliptical cylindrical reflectors is in the range of from about 0.2 to about 0.9 and is calculated from the formula $$e = (Z-z)/(Z+z)$$

where e is the eccentricity, Z is the distance of the second focus from the vertex of the ellipse and z is the distance of the first focus from the vertex of the ellipse. Usually the eccentricity is in the range of from about 0.5 to 0.8. While precisely elliptical reflectors are often employed in the invention, shapes which substantially approximate an ellipse and which introduce inconsequential aberrations may be used. In most systems, a circle closely approximates an ellipse and may be used in lieu of a precise ellipse without introducing appreciable undesirable aberrations. Lines tangent to the circular arc are sometimes used to approximate portions of the ellipse having slight curvature. Since most of the base members are formed by extruding aluminum through a die, use of lines and circular arcs permits easier fabrication of the die than if precisely elliptical arcs were employed. In one embodiment, for example, the concave curve of base member 28 is a circular arc of 6.668 centimeters radius which subtends an angle of 134 degrees at the center of the circle. The circular arc is symmetrical about the major axis of the ellipse being approximated. The two extremities of the base member are straight lines about 5.080 centimeters long tangent to the ends of the circular arc. Alzak aluminum sheet having a thickness of about 0.076 centimeter is attached to the inner surface of the base member using screws. The first focus of the substantially elliptical cylindrical reflector lies in the plane of symmetry and is 3.734 centimeters from the vertex of the reflector. The second focus also lies in the plane of symmetry and is 13.735 centimeters from the vertex of the reflector. The eccentricity of the reflector is therefore 0.572.

Figure 3:
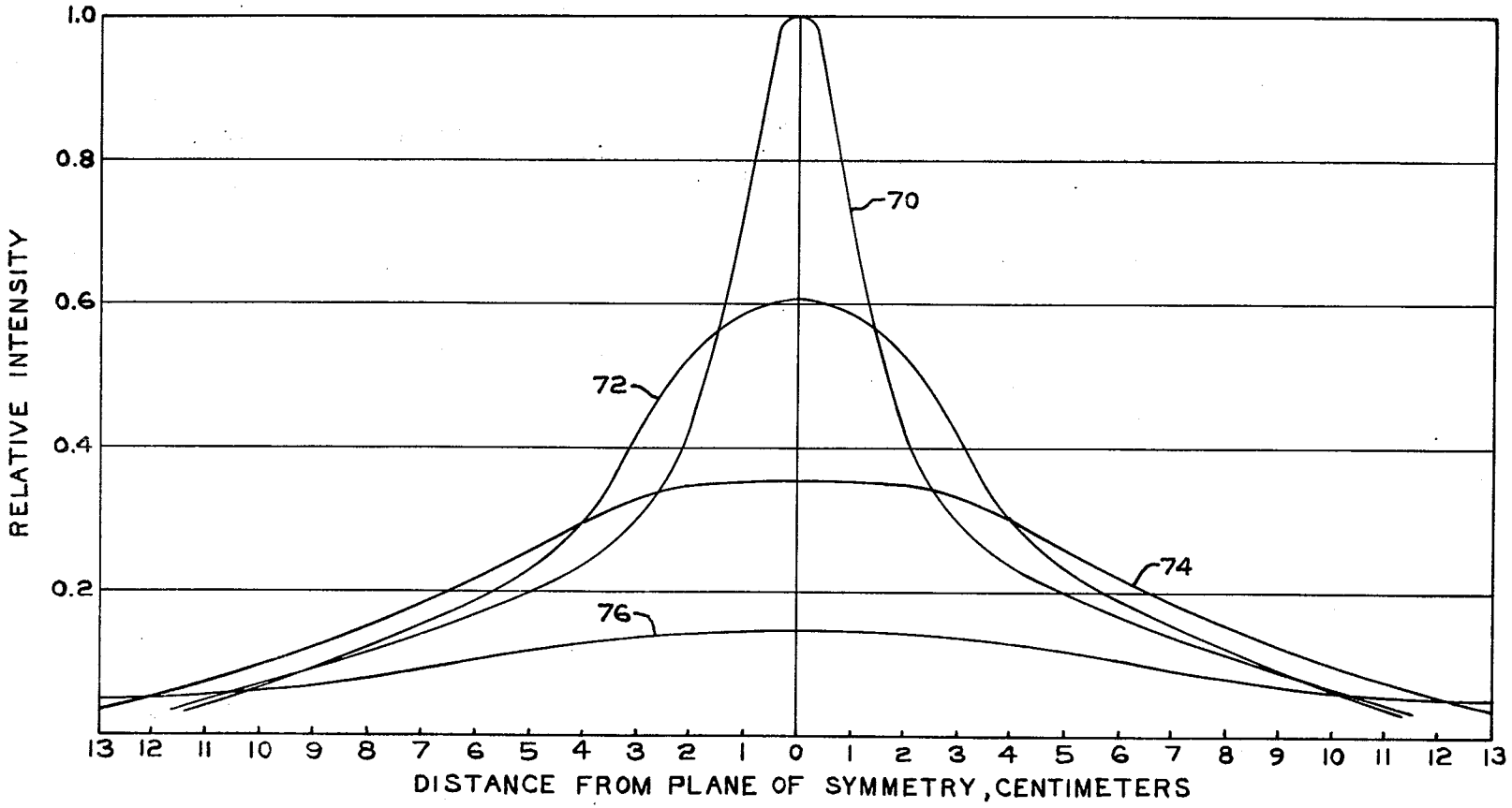
FIG. 3 shows intensity profiles of the reflector system of FIGS. 1 and 2.

FIG. 3 illustrates how the ultraviolet light intensity profile may be varied by raising or lowering the reflector of the ultraviolet light processor shown in FIGS. 1 and 2. Curve 70 shows the relative intensity in a plane containing the second focus of the concave substantially elliptical cylindrical reflector, which plane is perpendicular to the plane of symmetry of the optical system of the ultraviolet light processor, when the arc of a mercury vapor lamp is placed at the first focus. The plane in which the intensity is shown coincides with the path of travel of the coating 20 of workpiece 18 (see FIG. 1) as the workpiece is passed by the conveyor under the optical system of the processor. The remaining curves show the intensity profiles in the same plane after the reflector has been raised by various distances. Curves 72, 74 and 76 show the intensity profiles when the reflector has been raised 0.953 centimeters, 1.905 centimeters and 4.604 centimeters, respectively, above the position occupied corresponding to curve 70. Although the first and second foci of the reflector are raised with the reflector, all intensity profiles are shown for the path of travel of the coating 20. It will be observed that raising the reflector generally expands the width and reduces the magnitude of the central peak. In some instances, it is desirable to move the reflector closer to the lamp and substrate than the position of the reflector corresponding to curve 70.

Figure 4:
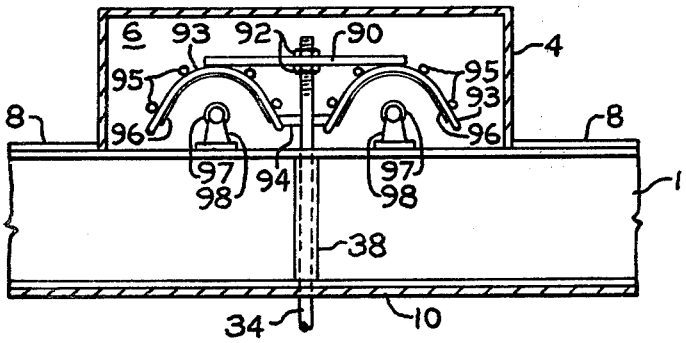
FIG. 4 illustrates a modification which may be made to the ultraviolet light processor of FIGS. 1 and 2.

FIG. 4 illustrates another embodiment of the invention which is a modification of the ultraviolet light processor of FIGS. 1 and 2. In this embodiment, the single lamp and reflector have been replaced by two lamps and two reflectors and necessary changes in supporting structure have been made. Otherwise the processor is the same as that shown in FIGS. 1 and 2. Rod 34 passes through a hole in beam 90 which is held in place by nuts 92. Near the ends of beam 90 are attached base members 93. Brace 94 provides additional rigidity. Conduits 95 for containing a circulating coolant may be attached to the base members. Reflectors 96 are attached to the concave side of the base members. Associated with each reflector is a mercury vapor lamp 97 held by lamp mounting brackets 98. Movement of the reflectors away from the lamps and the workpiece generally expands the width and reduces the intensity of the double peaked intensity curve.

Any suitable surce which emits ultraviolet light viz., electromagnetic radiation having a wavelenth in the range of from about 180 to about 400 nanometers, may be used in the practice of this invention. Suitable sources are mercury arcs, carbon arcs, low pressure mercury lamps, medium pressure mercury lamps, high pressure mercury lamps, swirlflow plasma arc and ultraviolet light emitting diodes. Particularly preferred are ultraviolet light emitting lamps of the medium or high pressure mercury vapor type. Such lamps usually have fused quartz envelopes to withstand the heat and transmit the ultraviolet radiation and are ordinarily in the form of long tubes having an electrode at both ends. Examples of these lamps are PPG Models 60-2032, 60-0393, 60-0197 and 60-2031 and Hanovia Models 6512A431, 6542A431, 6565A431 and 6577A431.

The voltages and currents used to operate the ultraviolet light sources are known in the art. When, for example, the ultraviolet light emitting lamps are medium pressure mercury lamps, each having a length of about 63.5 centimeters, an alternating current voltage of about 800 volts may be impressed across each lamp. Each lamp then draws about 6.4 amperes.

Substantially any ultraviolet light curable coating composition can be cured using the present invention. These ultraviolet light curable coating compositions contain at least one polymer, oligomer or monomer which is ultraviolet light curable. Examples of such ultraviolet light curable materials are unsaturated polyesters, acrylic (including the α-substituted acrylic) functional monomers, oligomers and polymers, the epoxy resins in admixture with masked Lewis acids, and the aminoplasts used in combination with a compound which ultraviolet light converts to an acid. Examples of such a compound to be used with aminoplast resins are the chloromethylated or bromomethylated aromatic ketones as exemplified by chloromethylbenzophenone.

The most commonly used ultraviolet light curable compounds contain a plurality of sites of ethylenic unsaturation which, under the influence of ultraviolet light become crosslinking sites through addition reactions. The sites of ethylenic unsaturation may lie along the backbone of the molecule or they may be present in side chains attached to the molecular backbone. As a further alternative, both of these arrangements may be present concurrently.

The organic ultraviolet light curable ethylenically unsaturated polyesters and the organic ultraviolet light curable acrylic oligomers, especially the oligomeric diacrylates and oligomeric dimethacrylates, constitute preferred classes of ultraviolet light curable compounds for use in the practice of this invention. An example of such an oligomeric diacrylate is 3-acrylyloxy-2,2-dimethylpropyl 3-acrylyloxy-2,2-dimethylpropionate.

Vinyl monomers which crosslink with the compound containing a plurality of sites of ethylenic unsaturation to form thermoset materials may be present in the coating composition. These monomers are preferably miscible with the compound and are preferably free of nonaromatic carbon-carbon conjugated double bonds. Examples of such vinyl monomers are styrene, divinyl benzene, methyl acrylate, methyl methacrylate, ethyl acrylate and butyl acrylate. The use of one or more vinyl monomers is desirable because the greater mobility of the smaller vinyl monomer molecule, as compared to the much larger first component, allows crosslinking to proceed faster than if the vinyl monomer were absent. Another benefit is that the vinyl monomer usually acts as a reactive solvent for the first component thereby providing coating compositions having a satisfactory low viscosity without using an inordinate amount, if any at all, of volatile, non-reactive solvent.

The vinyl monomer, or mixtures of vinyl monomers, may be employed over a broad range. At the lower end of the range, no vinyl monomer need be used. The upper end of the range is a moderate excess of vinyl monomer over the stoichiometric amount required to crosslink the ethylenic unsaturation of the first component. The amount of monomer should be sufficient to provide a liquid, flowable, interpolymerizable mixture. Ordinarily, the monomer will be present in the coating composition in the range of from about 0 to 45 percent by weight of the binder of the coating composition. When used, the vinyl monomer will ordinarily be in the range of from about 15 to about 30 percent by weight of the binder.

Extender pigments which are generally transparent to both ultraviolet light and visible light are optional ingredients which are often included in the coating composition. Examples of suitable extender pigments are finely divided particles of silica, barytes, calcium carbonate, talc, magnesium silicate, aluminum silicate, etc. Extender pigment is generally present in an amount in the range of from about 0 to about 40 percent by weight of the coating composition. An amount in the range of from about 0 to about 15 percent is more often employed. When extender pigment is used, it is usually present in the range of from about 1 to about 15 percent by weight of the coating composition. Although a single extender pigment is ordinarily used, mixtures of several extender pigments are satisfactory.

Opacifying or coloring pigments may also be included in the ultraviolet light curable coating compositions. The amount of these pigments should not be so great as to seriously interfere with the curing of the binder. Dyes and tints may similarly be included.

Another optional ingredient which is often included in the coating composition is an inert volatile organic solvent.

Photoinitiators, photosensitizers or both photoinitiators and photosensitizers are often included in ultraviolet light curable coating compositions. These materials are well known to the art. The preferred photosensitizer is benzophenone and the preferred photoinitiators are isobutyl benzoin ether, mixtures of butyl isomers of butyl benzoin ether and α,α-diethyoxyacetophenone.

The photoinitiator, photosensitizer or mixture of these is usually present in the ultraviolet light curable coating composition in an amount in the range of from about 0.01 percent to about 50 percent by weight of the binder of the coating composition. An amount in the range of from about 0.05 percent to about 10 percent is more often used. An amount in the range of from about 0.1 percent to about 5 percent is preferred.

Although several of the optional materials commonly found in ultraviolet light curable coating compositions have been described, the list is by no means inclusive. Other materials may be included for purposes known to the art.

Although the curing of the uncrosslinked coating composition (A-stage) may be carried out only until a gel (B-stage) is formed, it is generally preferred that curing should continue until the fully cured stage (C-stage) is obtained where the coating has been crosslinked into a hard, infusible film. These fully cured films exhibit the high abrasion resistance and high mar resistance customarily associated with C-stage polymer films.

The ultraviolet light curable coating compositions are used to form cured adherent coatings on substrates. The substrate is coated with the coating composition using substantially any technique known to the art. These include spraying, curtain coating, dipping, roller application, painting, brushing, printing, drawing and extrusion. The coated substrate is then passed under the reflectors of the ultraviolet light processor so that the coating is exposed to ultraviolet light of sufficient intensity for a time sufficient to crosslink the coating during the passage.

The times of exposure to ultraviolet light and the intensity of the ultraviolet light to which the coating composition is exposed may vary greatly. Generally the exposure to ultraviolet light should continue to the C-stage when hard, mar and abrasion resistant films result. In certain applications, however, it may be desirable for the curing to continue only to the B-stage.

Substrates which may be coated with the compositions of this invention to form workpieces may vary widely in their properties and may be of definite length or of long or indefinite length, such as a web. Organic substrates such as wood, fiberboard, particle board, composition board, paper, cardboard and various polymers such as polyesters, polyamides, cured phenolic resins, cured aminoplasts, acrylics, polyurethanes and rubber may be used. Inorganic substrates are exemplified by glass, quartz and ceramic materials. Many metallic substrates may be coated. Exemplary metallic substrates are iron, steel, stainless steel, copper, brass, bronze, aluminum, magnesium, titanium, nickel, chromium, zinc and alloys.

Cured coatings of the ultraviolet light curable coating composition usually have thicknesses in the range of from about 0.001 millimeter to about 0.007 millimeter to about 0.3 millimeter. When the ultraviolet light curable coating composition is an ultraviolet light curable printing ink, the cured coatings usually have thicknesses in the range of from about 0.001 millimeter to about 0.03 millimeter.

We claim:

1. An ultraviolet light processor for curing ultraviolet light sensitive coatings upon a workpiece, comprising:

a housing;

means for moving a coated workpiece through said housing;

at least one ultraviolet light source mounted in said housing for radiating ultraviolet light upon said coated workpiece moving through said housing, wherein said light source is of a generally linear configuration;

a concave substantially elliptical cylindrical reflector disposed in parallel relationship with said light source for reflecting ultraviolet light from said light source to said coated workpiece; and means for moving said reflector as a whole toward and away from said light source and said workpiece moving means to thereby change the distribution of intensity of ultraviolet light impinging upon said coated workpiece.

2. The ultraviolet light processor of claim 1 wherein the eccentricity of said concave substantially elliptical cylindrical reflector is in the range of from about 0.2 to about 0.9.

3. The ultraviolet light processor of claim 1 wherein the light source and said concave substantially elliptical cylindrical reflector are disposed transversely to the direction of workpiece movement.

4. The ultraviolet light processor of claim 1 including at least one conduit affixed to said reflector for carrying coolant to cool said reflector.

5. The ultraviolet light processor of claim 1 wherein said means for moving a workpiece is a conveyor.

* * * * *